US008210968B2

(12) United States Patent
Chen

(10) Patent No.: US 8,210,968 B2
(45) Date of Patent: Jul. 3, 2012

(54) TABLE TENNIS BASKETBALL TABLE

(76) Inventor: Samuel Chen, Shanghai (CN)

( * ) Notice: Subject to any disclaimer, the term of this patent is extended or adjusted under 35 U.S.C. 154(b) by 156 days.

(21) Appl. No.: 12/908,173

(22) Filed: Oct. 20, 2010

(65) Prior Publication Data

US 2012/0100937 A1 Apr. 26, 2012

(51) Int. Cl.
*A63B 69/00* (2006.01)
*A63B 67/04* (2006.01)

(52) U.S. Cl. ..... 473/433; 473/496; 473/479

(58) Field of Classification Search ..... 473/433, 473/496, 479, 481, 482, 485, 488; 273/317.3; 108/11, 161
See application file for complete search history.

(56) References Cited

U.S. PATENT DOCUMENTS 3,399,889 A * 9/1968 Harry ..... 473/481
4,291,885 A * 9/1981 Cohen ..... 273/348.5
5,443,259 A * 8/1995 Segan et al. ..... 273/352
5,630,760 A * 5/1997 Brown et al. ..... 273/108.52
5,655,979 A * 8/1997 Blue ..... 473/475
5,910,058 A * 6/1999 Zheng ..... 473/481
6,082,736 A * 7/2000 Barlow ..... 273/317.1
6,761,649 B1 * 7/2004 Medley, Jr. ..... 473/433
7,156,763 B1 * 1/2007 Liao ..... 473/496
7,427,100 B2 * 9/2008 Joseph ..... 297/118
8,109,835 B2 * 2/2012 Norris ..... 472/93
2005/0284343 A1 * 12/2005 Kettler et al. ..... 108/170
2012/0100937 A1 * 4/2012 Chen ..... 473/433

* cited by examiner

*Primary Examiner* — Raleigh W. Chiu
(74) *Attorney, Agent, or Firm* — Clement Cheng

(57) ABSTRACT

A table tennis basketball table includes a front leaf forming a front half of a table tennis table. The front leaf is pivotally mounted so that it folds from a horizontal position to a stowed vertical position. A rear leaf forms a rear half of a table tennis table. The rear leaf is pivotally mounted so that it folds from a horizontal position to a stowed vertical position. The table tennis basketball table has a table tennis mode when the front leaf and the rear leaf or in horizontal position. The table tennis basketball table has a basketball mode so that the front leaf is horizontal and the rear leaf is vertical. A pair of net support posts is movable and supports a net between them. The net support posts are mountable to a surface of the front leaf or a surface of the rear leaf.

19 Claims, 6 Drawing Sheets

TABLE TENNIS BASKETBALL TABLE

FIELD OF THE INVENTION

This invention relates to a convertible game table.

SUMMARY OF THE INVENTION

A table tennis basketball table includes a front leaf forming a front half of a table tennis table. The front leaf is pivotally mounted so that it folds from a horizontal position to a stowed vertical position. A rear leaf forms a rear half of a table tennis table. The rear leaf is pivotally mounted so that it folds from a horizontal position to a stowed vertical position. The table tennis basketball table has a table tennis mode when the front leaf and the rear leaf or in horizontal position. The table tennis basketball table has a basketball mode so that the front leaf is horizontal and the rear leaf is vertical. A pair of net support posts is movable and supports a net between them. The net support posts are mountable to a surface of the front leaf or a surface of the rear leaf.

A right side net is adapted to be connected between the rear leaf and the front leaf. A left side net is adapted to be connected between the rear leaf and the front leaf. A basketball goal is mountable at an upper portion of the rear leaf when the rear leaf is in basketball mode. A front outside vertical leg is mounted in swivel connection to the front leaf section. The front outside vertical leg supports the front leaf section when the front leaf section is in basketball mode and when the front leaf section is in table tennis mode.

A rear outside vertical leg is mounted in swivel connection to the rear leaf section. The rear outside vertical leg hangs down from the back leaf section when the back leaf section is in basketball mode. The rear outside vertical leg supports the rear leaf section when the rear leaf section is in table tennis mode. A leg support structure comprises an outside across support and an inside vertical leg. The outside across support connects between the outside vertical leg and the inside vertical leg to form a four bar mechanism with the rear leaf section.

The right side net and the left side net are suspended from a pair of sidelines, namely a right sideline supporting the right side net and a left sideline supporting the left side net. The right side net and the left side net have a triangular shape. The basketball goal has a backboard, a rim, and a net, wherein the basketball goal is secured to the rear leaf section by at least one backboard leg extending behind the back leaf section. The basketball goal flips underneath the back leaf section for storage when the table tennis basketball table used in table tennis mode. The right side net and the left side net can be connected between the rear leaf and the front leaf and also connected to the rear leaf and the front leaf along an edge of the side of the rear leaf and the front leaf. The right side net and the left side net can also be suspended from a pair of sidelines, namely a right sideline supporting the right side net and a left sideline supporting the left side net. Optionally, the pair of sidelines are elastic and the right side net and the left side net are also optionally made of elastic material.

Preferably the right side net and the left side net are continuous and connected together and the right side net and the left side net come together to form a scoop pocket in front.

Figure 1:
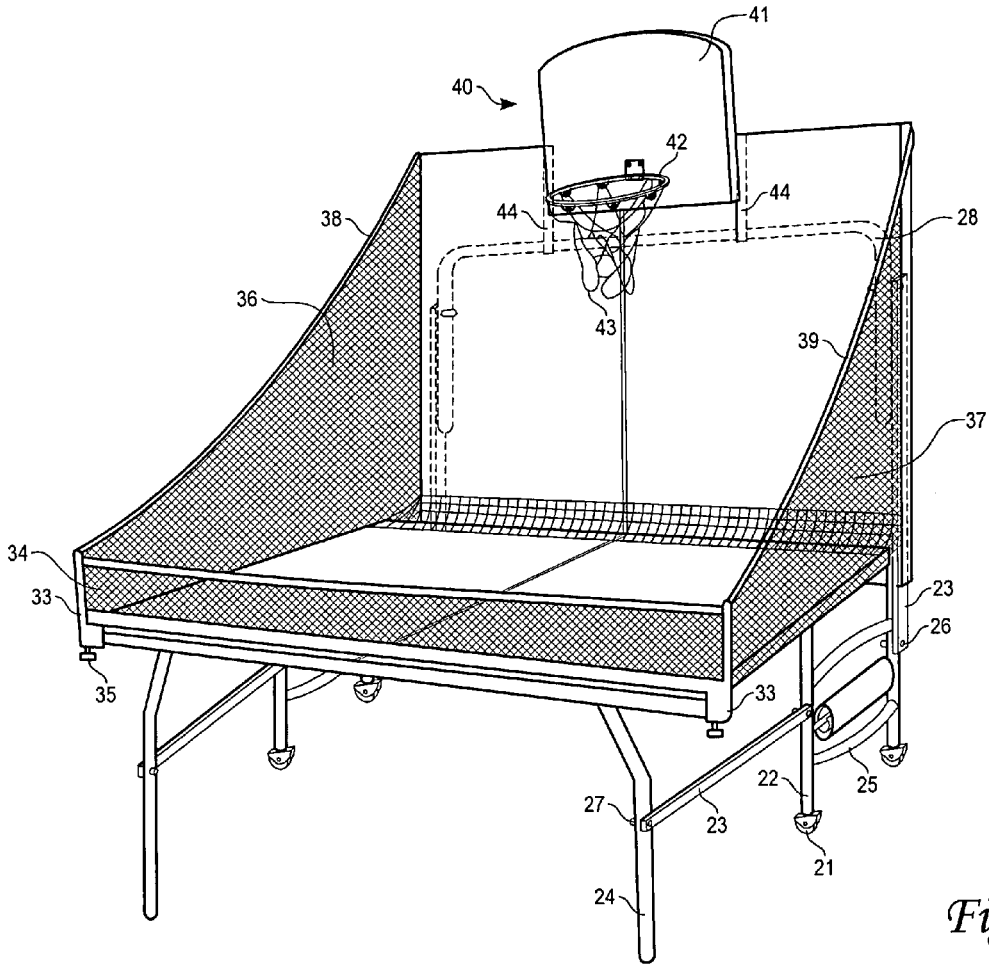
FIG. 1 is a perspective view of the game table in basketball mode.
Figure 2:
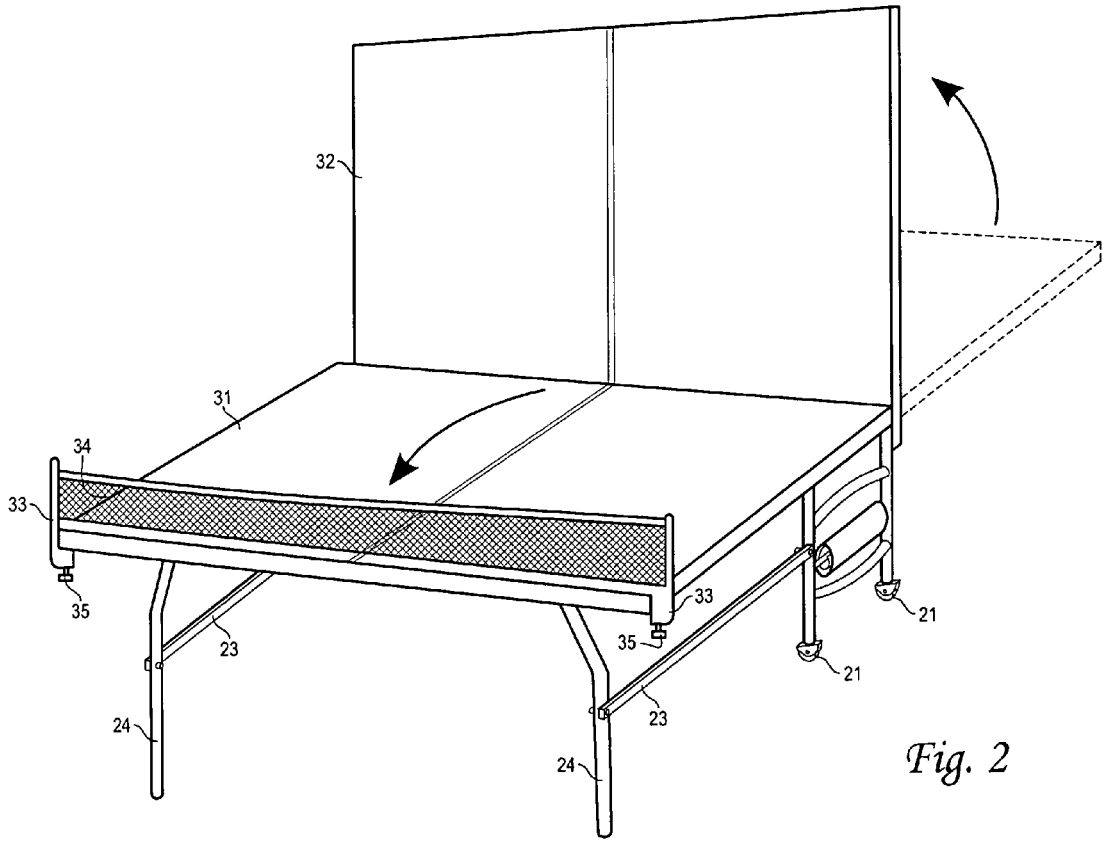
FIG. 2 is a perspective view of the game table transforming from table tennis mode to basketball mode.
Figure 3:
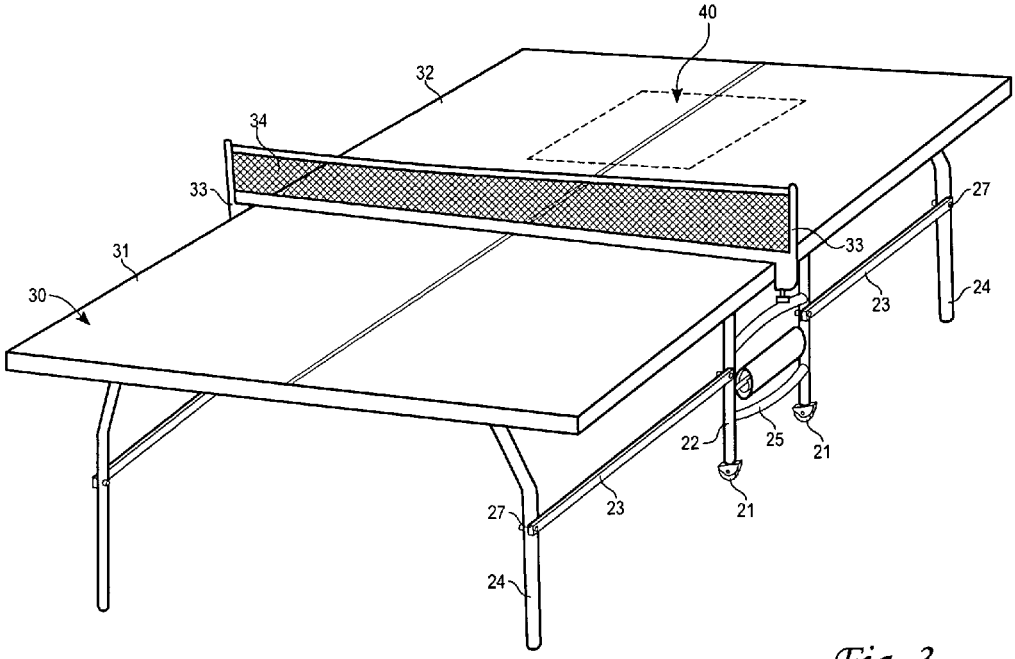
FIG. 3 is a perspective view of the game table in table tennis mode showing that the basketball goal is tucked underneath the table.
Figure 4:
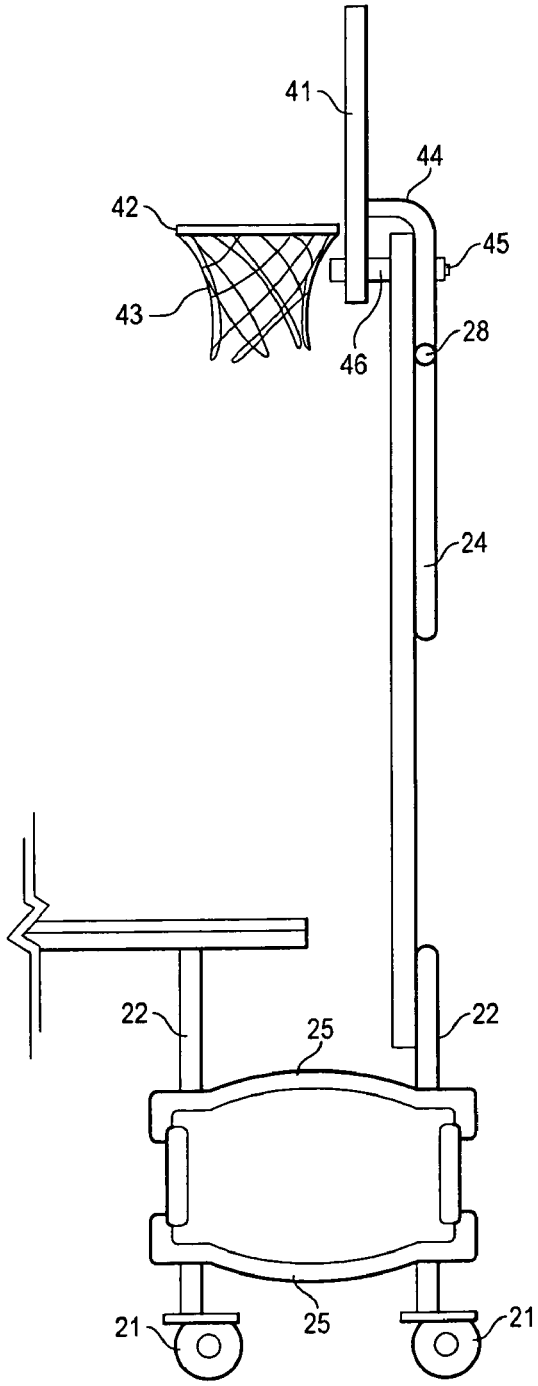
FIG. 4 is a side view of the game table in basketball mode.

The following call out list of elements is used consistently in the drawings.

21 Caster Assembly
22 Inside Vertical Leg
23 Outside Across Support
24 Outside Vertical Leg
25 Inside Across Support
26 Inside Folding Joint
27 Outside Folding Joint
28 Leg Swivel
31 Front Leaf Section
32 Rear Leaf Section
33 Net Support Post
34 Net
35 Net Post Knob
36 Left Side Net
37 Right Side Net
38 Left Sideline
39 Right Sideline
40 Basketball Goal
41 Back Board
42 Rim
43 Net
44 Backboard Legs
45 Backboard Connector
46 Spacer

DETAILED DESCRIPTION OF THE PREFERRED EMBODIMENT

As shown in the drawings, the key feature of this invention is a conversion of a game table from table tennis mode to a basketball mode. A first mode is a table tennis mode where users can play table tennis. A second mode is a basketball mode where users can play basketball. The table tennis mode would be played with regular table tennis equipment. The basketball mode can be played with table tennis equipment, small rubber basketballs, inflated balls or with soft foam sponge balls.

The basketball goal 40 is mounted to a top portion of a rear leaf section 32. The basketball goal includes a backboard 41, a rim 42 and a net 43 mounted to the rim 42. The basketball goal 40 is mounted with preferably a pair of backboard legs 44 which could be formed as tubular metal members that swivel up from underneath the table. The backboard legs 44 can share the swivel 28 with the folding legs such that the same swivel accommodates both the backboard legs 44 and the outside vertical legs 24.

A backboard connector 45 connects between the underside of the table and the backboard legs 44. The backboard connector 45 secures the backboard legs 44 to the rear leaf section 32. The backboard connector 45 can be a knob that engages into a rear leaf section 32. The backboard connector 45 can also be magnetic, or a screw connector. Optionally, a spacer 46 may push against a playing surface of the rear leaf section 32.

The rear leaf section also includes a leg swivel 28 where the outside vertical leg 24 is mounted to an underside of the front leaf section 31 and the rear leaf section 32. The rear leaf section 32 has a pair of outside vertical legs 24 folded parallel to the rear leaf section 32 when the rear leaf section 32 is in vertical orientation such as when the table is stowed or when the table is in basketball mode.

The table can be in stowed position when both of the leafs are folded to be vertical. Preferably, the rim 42 has a small enough diameter to fit between the rear section 32 and the front leaf section 31. When the table is in stowed position, both of the outside vertical legs 24 fold downward so that the outside vertical legs 24 are in vertical orientation hanging down from the leaf sections. The motion of the outside vertical legs 24 is guided by outside across supports 23. A total of four outside vertical legs form a part of the support structure and a pair of outside vertical legs support each of the pair of leaf sections.

Additionally, a pair of inside vertical legs 22 support each leaf section such that there are a total of preferably four inside vertical legs 22. The inside vertical legs are connected to the outside vertical legs with outside across supports 23. A pair of outside across supports connect each section such that a total of four outside across supports connect between the outside vertical leg and the inside vertical leg. The outside across support 23 is connected to the outside vertical leg at an outside pin joint also called an outside swivel joint 27. The outside across support 23 is also connected to the inside vertical leg at a pivoting joint on the inside also called an inside swivel joint 26. The inside vertical leg 22 of the front leaf section is connected to the inside vertical leg 22 of the back leaf section 32. Preferably, a pair of inside leg across supports 25 are connecting on the left side and the right side for a total of four inside leg across supports. Parallel to the inside leg across supports are a pair of minor across members having a fabric wrap on them. The fabric wrap may be used as a handle or for signage such as application of a logo. The inside leg across supports 25 may comprise a lower inside leg across support and an upper inside leg across support. The lower inside leg across support can be curved downward and the upper inside leg across support can be curved upward. A pair of caster assemblies 21 are preferably mounted on each of the left and right sides underneath the inside vertical legs to provide rolling when the table tennis table is in stowed position with both leaves vertical. Vertical and horizontal as used herein means approximately vertical, and approximately horizontal, and not exactly 90° or perfectly orthogonal, since it is not required that any of the members which are horizontal or vertical need to be exactly 90° for the device to fulfill its intended purpose. Vertical means upright.

The leg swivel 28 can be formed as a standard leg swivel where the tube of the right outside vertical leg 24 meets with the tube of the left outside vertical leg in a horizontal outside vertical leg section. The horizontal outside vertical leg section can be secured to the underside of the front leaf section 31 or the rear leaf section 32 in a swivel connection. It is preferred that the table tennis table has a four bar leg support structure. The outside across support 23 is parallel to the table leaf that it supports by forming a four bar mechanism with the table leaf as a first bar, the outside vertical leg as a second bar, the inside vertical leg as a third bar and the outside across support as a fourth bar.

The steps for transforming the table from table tennis mode to basketball mode include first moving the net support post 33 to the front of the table as seen in FIG. 1. The net support post 33 supports a net 34 and a pair of post support knobs 35 secures the pair of net support posts 33 to the table. The net post knob provides a releasing mechanism to allow connection and reconnection two different locations on the table. The net support post 33 is therefore movable along the table.

The left side net 36 is then raised and connecting between the net support post 33 tip portion to the apex of the rear leaf section 32 in vertical configuration. The left side net 36 can be connected to a side edge of the rear leaf section 32. If the left side net 36 is connected to the side edge, the left side net 36 can be rolled up and secured with hook and loop tape straps underneath the table so that when he needs to be deployed in a deployed position, a user releases the hook and loop tape straps and unfurls the left side net 36. The left sideline 38 connects and forms an upper bound of the left side net 36 the left sideline 38 can be a border of the left side net 36. Similarly, the right side net 37 can be connected and suspended from a right sideline 39 which travels between a rear leaf section 32 top right side to a right net support post 33 mounted at the front of the table.

After the netting is set up, a user may release the basketball goal 40 by disengaging the backboard connector 45 which can be formed as a latch mechanism. The basketball goal 40 when in table tennis position is flipped underneath the table so that the basketball goal 40 is underneath the table with the backboard 41 defining a plane that is parallel or approximately parallel to the plane of the rear leaf section 32. The basketball goal 40 Also be alternatively entirely detachable and attachable to the bottom of the rear leaf section 32, but the preferred construction is having a swivel connection on an axis defined by the swivel connection 28. The connection between the backboard 41 and the backboard legs 44 can be a swivel connection. The backboard preferably also includes a backboard spacer 46 that then also help securing the connection. The backboard connector 45 can be turned by hand or can be a latch that is operated by hand pull or turn for connection to an underside of the rear leaf section 32.

Figure 5:
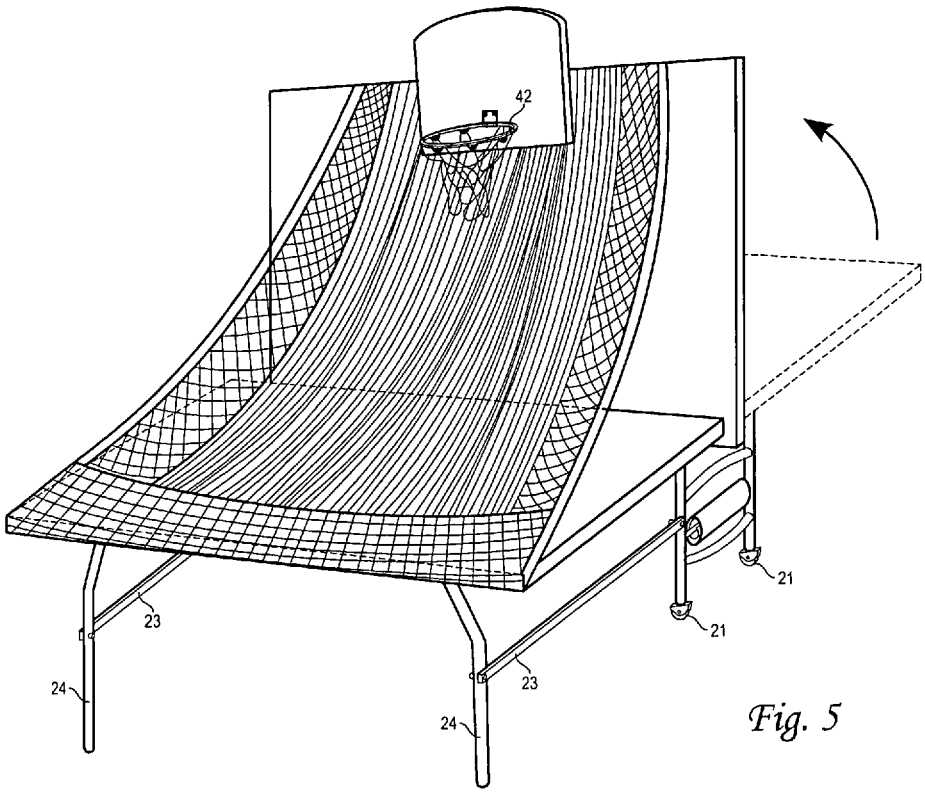
FIG. 5 is a perspective view of the game table in basketball mode.
Figure 6:
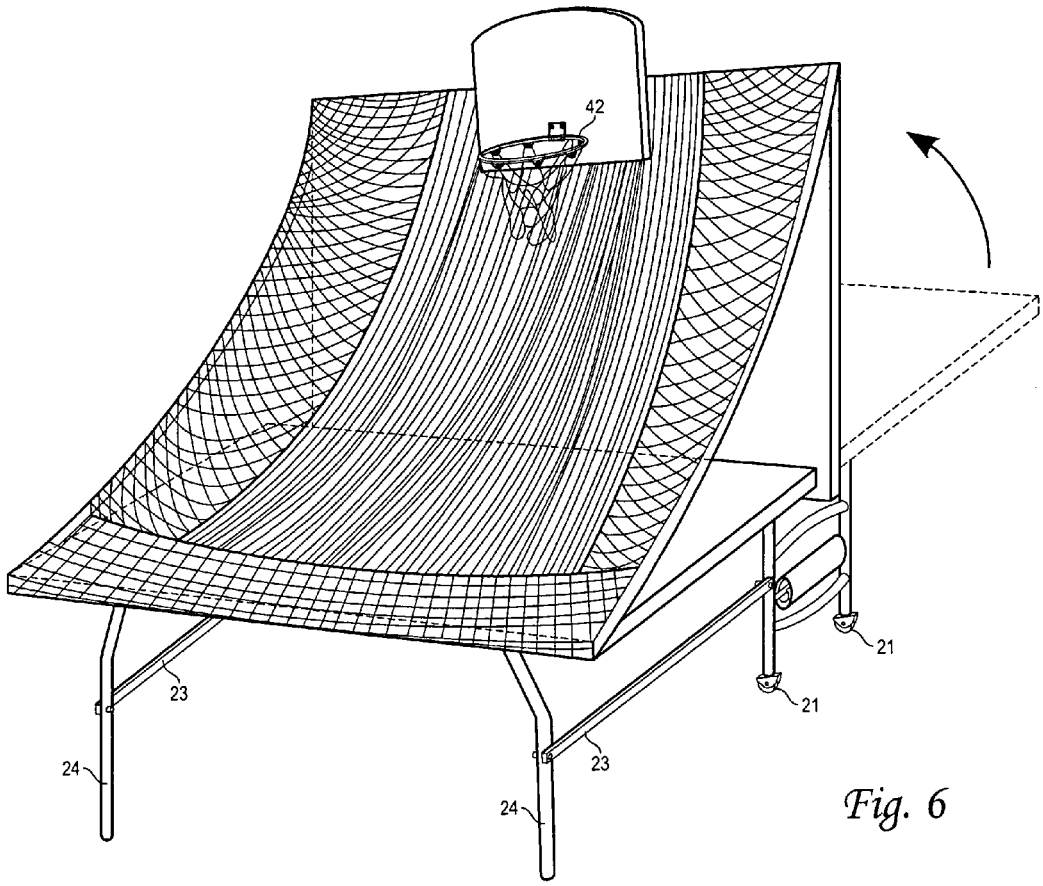
FIG. 6 is a perspective view of the game table in basketball mode.

Alternate methods of attaching a net are shown. These alternate methods have something in common which is that the net for catching the basketball is connected between the rear leaf and the front leaf. The net can be formed as a right and left net which are either continuous as shown in FIG. 5, 6, or separate as shown in FIG. 1. The right and left net are preferably continuous to form a single big net. A gap net can also be installed to cover up the gap between the leaves of the table. The preferred method is to have the net formed as a scoop with a front pocket. The single net having the right net and left net formed together can be hung from the top edge of the rear leaf and the top corners of the single net can be either at the corners of the top edge of the rear leaf or anywhere along the top, such as somewhere not at a corner as shown in FIG. 5. The scoop shape with front pocket provides a catching basin for the basketballs. When the basketball make the basket or miss the basket and are rolling down back to the user, the front pocket provides a catch.

A variety of minor modifications to the design can be made, such as by connecting the left sideline and the right sideline to only the corners of the table instead of connecting the left sideline and the right sideline to the net support post and corners of the table.

The invention claimed is:

1. A table tennis basketball table comprising:

a. a front leaf forming a front half of a table tennis table, wherein the front leaf is pivotally mounted so that it folds from a horizontal position to a stowed vertical position;

b. a rear leaf forming a rear half of a table tennis table, wherein the rear leaf is pivotally mounted so that it folds from a horizontal position to a stowed vertical position, wherein the table tennis basketball table has a table tennis mode when the front leaf and the rear leaf or in horizontal position, and wherein the table tennis basketball table has a basketball mode when the front leaf is horizontal and the rear leaf is vertical;

c. a pair of net support posts that are movable and which support a net between them, wherein the net support posts are mountable to a surface of the front leaf or a surface of the rear leaf;

d. a right side net adapted to be connected between the rear leaf and the front leaf;

e. a left side net adapted to be connected between the rear leaf and the front leaf;

f. a basketball goal mountable at an upper portion of the rear leaf when the rear leaf is in basketball mode;

g. a front outside vertical leg mounted in swivel connection to the front leaf section, wherein the front outside vertical leg supports the front leaf section when the front leaf section is in basketball mode and when the front leaf section is in table tennis mode; and h. a rear outside vertical leg mounted in swivel connection to the rear leaf section, wherein the rear outside vertical leg hangs down from the back leaf section when the back leaf section is in basketball mode, wherein rear outside vertical leg supports the rear leaf section when the rear leaf section is in table tennis mode.

2. The table tennis basketball table of claim 1, wherein the right side net and the left side net are suspended from a pair of sidelines, namely a right sideline supporting the right side net and a left sideline supporting the left side net.

3. The table tennis basketball table of claim 1, wherein the right side net and the left side net have a triangular shape.

4. The table tennis basketball table of claim 1, wherein the basketball goal has a backboard, a rim, and a net, wherein the basketball goal is secured to the rear leaf section by at least one backboard leg extending behind the back leaf section.

5. The table tennis basketball table of claim 1, wherein the basketball goal flips underneath the back leaf section for storage when the table tennis basketball table used in table tennis mode.

6. The table tennis basketball table of claim 1, wherein the right side net and the left side net are connected between the rear leaf and the front leaf and also connected to the rear leaf and the front leaf along an edge of the side of the rear leaf and the front leaf.

7. The table tennis basketball table of claim 1, wherein the right side net and the left side net are suspended from a pair of sidelines, namely a right sideline supporting the right side net and a left sideline supporting the left side net, wherein the pair of sidelines are elastic.

8. The table tennis basketball table of claim 1, wherein the right side net and the left side net are made of elastic material.

9. The table tennis basketball table of claim 1, further comprising a leg support structure which comprises an outside across support and an inside vertical leg, wherein the outside across support connects between the outside vertical leg and the inside vertical leg to form a four bar mechanism with the rear leaf section.

10. The table tennis basketball table of claim 9, wherein the right side net and the left side net are suspended from a pair of sidelines, namely a right sideline supporting the right side net and a left sideline supporting the left side net.

11. The table tennis basketball table of claim 9 wherein the right side net and the left side net have a triangular shape.

12. The table tennis basketball table of claim 9, wherein the basketball goal has a backboard, a rim, and a net, wherein the basketball goal is secured to the rear leaf section by at least one backboard leg extending behind the back leaf section.

13. The table tennis basketball table of claim 9, wherein the basketball goal flips underneath the back leaf section for storage when the table tennis basketball table used in table tennis mode.

14. The table tennis basketball table of claim 9, wherein the right side net and the left side net are connected between the rear leaf and the front leaf and also connected to the rear leaf and the front leaf along an edge of the side of the rear leaf and the front leaf.

15. The table tennis basketball table of claim 9, wherein the right side net and the left side net are suspended from a pair of sidelines, namely a right sideline supporting the right side net and a left sideline supporting the left side net, wherein the pair of sidelines are elastic.

16. The table tennis basketball table of claim 9, wherein the right side net and the left side net are made of elastic material.

17. The table tennis basketball table of claim 1, wherein the right side net and the left side net are continuous and connected together.

18. The table tennis basketball table of claim 1, wherein the right side net and the left side net are continuous and not connected together.

19. The table tennis basketball table of claim 1, wherein the right side net and the left side net are continuous and connected together and wherein the right side net and the left side net come together to form a scoop pocket in front.

* * * * *